US005257778A

United States Patent [19]

Coombs et al.

[11] Patent Number: 5,257,778

[45] Date of Patent: Nov. 2, 1993

[54] SORTER WITH MOLDED TRAY SHIFTING CAM CONSTRUCTION AND METHOD OF MAKING THE CAM

[75] Inventors: Peter M. Coombs, Tustin; Newton H. Lee, Jr., Dana Point, both of Calif.; Klaus Thogersen, Klampenborg, Denmark; Frederick J. Lawrence, Tustin, Calif.

[73] Assignee: Gradco (Japan) Ltd., Tokyo, Japan

[21] Appl. No.: 28,096

[22] Filed: Mar. 8, 1993

[51] Int. Cl.[5] ..... B65H 39/10

[52] U.S. Cl. ..... 271/293; 74/567

[58] Field of Search ..... 271/292, 293; 74/567

[56] References Cited

U.S. PATENT DOCUMENTS

| | | | |
|---|---|---|---|
| 2,184,723 | 12/1939 | Parks | 74/567 |
| 4,478,406 | 10/1984 | DuBois | 271/293 |
| 4,512,565 | 4/1985 | Matsumoto et al. | 271/293 |
| 4,638,992 | 1/1987 | Johdai et al. | 271/293 |
| 4,842,264 | 6/1989 | Kosaka et al. | 271/293 |

FOREIGN PATENT DOCUMENTS

| | | | |
|---|---|---|---|
| 4-92148 | 3/1992 | Japan | 74/567 |

*Primary Examiner*—H. Grant Skaggs
*Attorney, Agent, or Firm*—Newton H. Lee, Jr.

[57] ABSTRACT

A sorter has a tray moving cam construction which is an assembly of molded plastic parts including an elongated noncircular shaft and a pair of similar cam parts turned 180°, end-to-end and having a hub slidably applicable to the shaft from opposite ends, or over opposite ends of a supporting core shaft, the hubs or the core shaft having an axial opening conforming with the noncircular shaft keying them together for rotation, and complemental cam segments on the hubs combine to provide a complete cam profile when the cam parts are applied to the shaft or core shaft in opposite axial directions from opposite ends of the shaft. The shaft and cam parts may have complemental interengaging portions locking the cam parts in operative assembled relation on the shaft against relative axial movement, or the cam parts and the core may have complemental inter-engaging portions locking the cam parts in assembled relation on the shaft or the core shaft but permitting longitudinal movement of the assembled cam or cam and core on the shaft.

10 Claims, 5 Drawing Sheets

Fig. 4
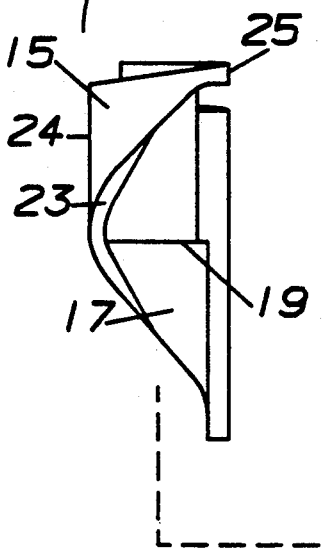
Fig. 2
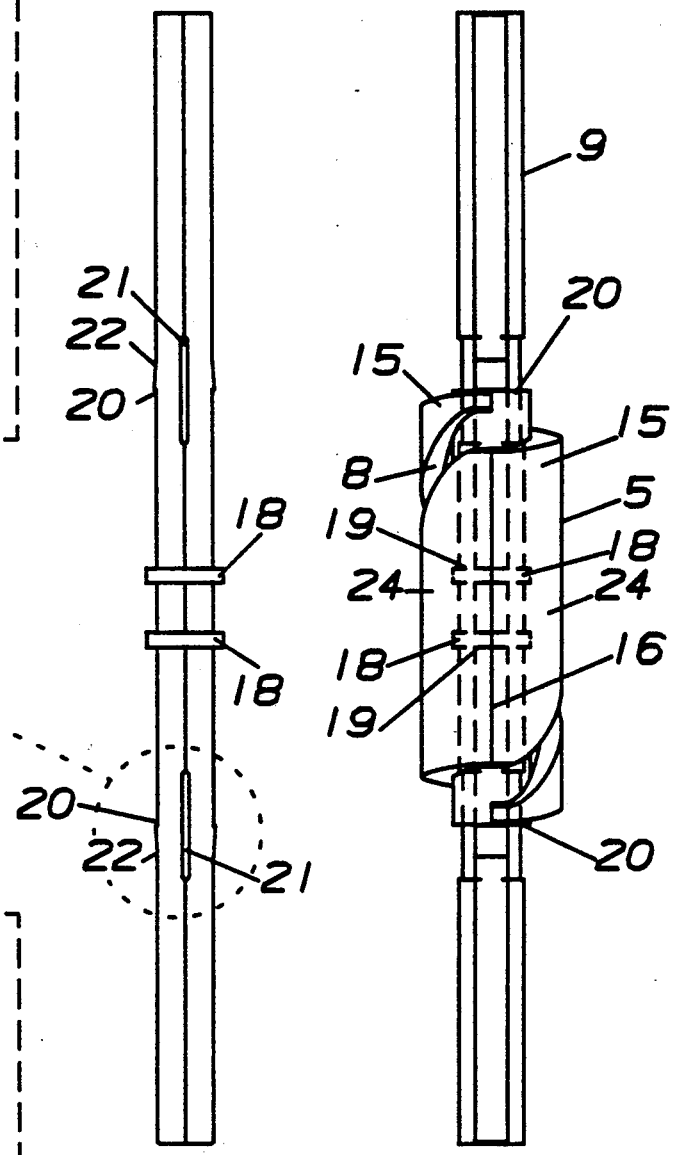
Fig. 4a
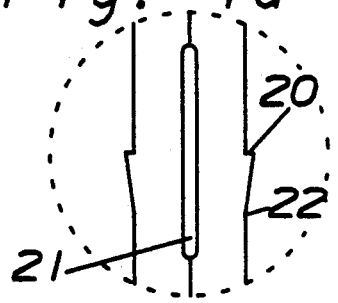
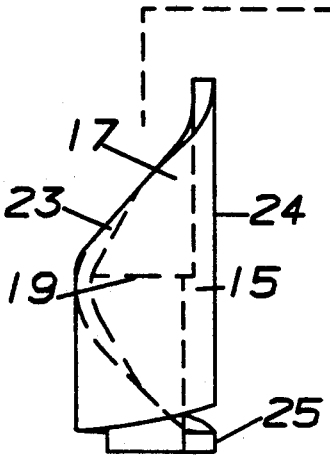
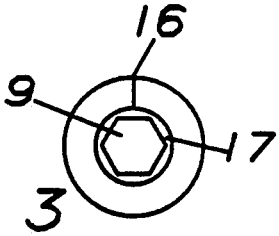
Fig. 3

120
18
18

SORTER WITH MOLDED TRAY SHIFTING CAM CONSTRUCTION AND METHOD OF MAKING THE CAM

BACKGROUND OF THE INVENTION

There are extant various paper sheet collating and sorting machines of the types employing rotary cams to shift or move paper receiving trays between closely spaced relation at opposite sides of a sheet inlet and widely spaced positions for receiving sheets from the sheet inlet.

Such sorting machines are shown, by way of examples, in the following U.S. Pat. Nos.: Stemmle U.S. Pat. No. 3,778,640; Lawrence U.S. Pat. Nos. 4,343,463 and 4,911,424; Sasaki U.S. Pat. No. 5,090,688; DuBois U.S. Pat. No. 4,478,406 and U.S. Pat. No. Maruyama 4,580,775, as well as in the application of P. Coombs filed Mar. 9, 1992, Ser. No. 848,489, co-owned herewith and incorporated herein by reference. The spiral cams of such sorting machines may be machined from solid stock or molded from low friction plastic material. Molding the cams is a difficult and costly procedure due to the fact that the cam profile is most generally formed so that there is a variation in the helix or cam angle, thus requiring a mold of many pieces due to angle differences and resultant mold parting line ridges on the cam profile. On the other hand, rotary removal of a molded cam from a mold is simple in the case that the helix angle is constant by simply unscrewing the cam from the mold.

SUMMARY OF THE INVENTION

The present invention, as best defined in the claims appended hereto, provides a novel molded cam construction in sorting machines as referred to above and a method for making such cams.

More particularly, the invention contemplates a helical cam construction resulting from molding a pair of identical or nearly identical cam half-parts which can be rotated 180° by turning end to end and interlocked with one another on a cam drive shaft to form a cam unit in an inexpensive and efficient manner, thereby reducing the overall cost of the sorter.

More specifically, the invention provides a helical cam construction as just referred to above wherein the helical cam parts are locked in position on the drive shaft and against axial displacement of the cam on the shaft in sorting machines wherein the cam moves the trays from one side to the other side of a sheet inlet.

Alternatively, the helical cam construction is composed of half parts which are interlocked together on a drive shaft on which the cam moves axially of the shaft during operation of the sorter apparatus as the cam shifts from tray to tray and opens the trays to receive sheets of paper from the sheet infeed that moves with the cams.

In accomplishing the foregoing, identical or nearly identical cam half parts are molded from a low friction plastic material. The nearly identical cam parts are so formed that the difference in form does not inhibit the use of a simple mold from which the half parts can be readily removed without requiring complex mold constructions. The half parts have identical cam profile surfaces so that upon 180° rotation inversion of the half parts relative to one another and axial assembly on a shaft in juxtaposed relation on the shaft or on a supporting core shaft, with the cam profile surfaces opposed to one another, the surfaces form a helical groove or cam track extending end to end of the assembled cam. With such a production method and assembly, the cam parts are molded in a simple mold but the resultant cam profile can have the desired continually varying helix angle which provides the sorter assembly with smoothness and quietness of operation resulting from smooth acceleration and deceleration of relative tray and cam movement and smooth loading and unloading of the cam and cam followers.

In the practice of the invention, the sorter may be of the moving bin type or the moving bin opener type as disclosed in the above referenced prior patents.

In the case of the moving bin type sorters, wherein the cam is rotatable with the cam drive shaft and is fixed on the shaft against axial displacement, to move sorter trays relative to the cam, the invention provides for end wise assembly of the cam half parts and interlocking of the cam parts with one another and with the shaft. In the case of a moving bin opener type sorters, wherein the cam is rotatable with the shaft and is axially movable on the shaft, as the cam moves from tray to tray, the invention provides for assembly of the cam half parts and interlocking of the cam half parts together while the cam assembly is free to move axially of the shaft while the shaft rotates. The cam parts may, in this type of sorter, be assembled on a core shaft or sleeve which is slidable on but rotatable with the drive shaft.

The invention has other features and advantages which will be hereinafter described or will become apparent from the following description with reference to the accompanying drawings.

BRIEF DESCRIPTION OF THE DRAWINGS

FIG. 2 is an elevational view showing the cam and shaft assembly for the sorter of FIG. 1, with the cam axially fixed on the shaft;

FIG. 3 is a bottom plan of the cam assembly of FIG. 2;

FIG. 4 is an exploded detail view showing the components of the assembly of FIG. 2 but with the cam shaft rotated 90°;

FIG. 4*a* is an enlarged detail of the shaft section encircled by broken lines in FIG. 4;

DESCRIPTION OF THE PREFERRED EMBODIMENTS

Figure 1:
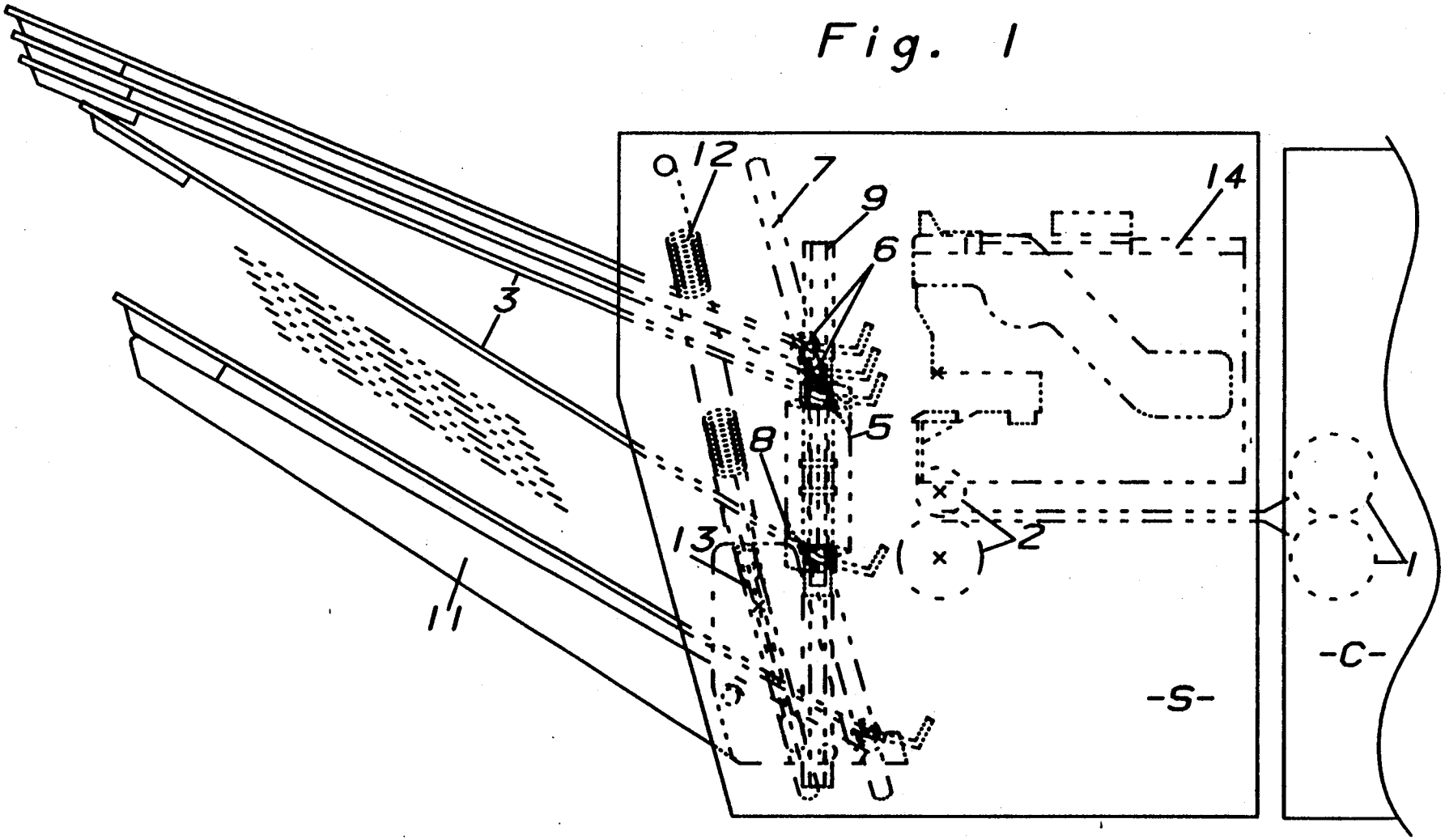
FIG. 1 is a side elevation of a sorting machine of the moving bin type utilizing a bin shifting cam in accordance with the invention.

Referring first to FIG. 1, there is shown a sorter S of the moving bin type more specifically shown in the above referenced application Ser. No. 848,489, co-owned herewith and to which reference may be made, adapted to receive sheets of paper from an office copier or printer C. Sheets fed from the copier or printer by output feed roll means 1 are supplied to the sorter and carried by infeed rolls 2 to sorter trays 3 arranged in a stack and adapted to be successively moved vertically at the inner tray ends by rotary cams 5.

In practice a pair of cams 5 are located at opposite sides of the sorter assembly. The trays have cam followers or trunnions 6 guided in vertical slots 7 in the sorter frame structure for movement between positions above and below the cams as the trunnions engage in a helical cam slot or track 8 responsive to rotation of the cam shaft 9, in opposite directions. The height of the cam 5 determines the clearance space between the inner tray ends into which the paper sheets are fed by the feed rollers 2. Drive means (not shown) are provided to drive the cam shafts in unison, through one revolution to effect intermittent movement of the trays in the desired direction under the control of the cam drive and sheet detector system employed in such sorters.

In the form shown, the sorter has a bottom lift tray or support 11 which may or may not function to receive sheets.

The lift tray moves vertically relative to the sorter frame structure and extends outwardly beneath and supports the outer end of the lowermost tray, with the outer ends of the trays above supported one on the other for pivotal and longitudinal sliding movement, as the inner ends of the trays move vertically to their respective positions above or below the sheet infeed.

At its inner end, the lower tray support is also mounted for vertical movement in the frame structure. In some constructions such upward movement is under the influence of the cam, as seen in prior U.S. Pat. Nos., 4,911,424 and 5,090,688 referred to above. In other constructions the lower tray support is lifted by the upward influence of a lift spring 12 as in the present embodiment and in the sorter of said application Ser. No. 848,489. In the form shown, the bottom tray support is moved upwardly by the spring 12 in vertically extended guide slots 13 and thereby the spring 12 urges the trays between the bottom support 11 and the lower end of the cams 5 upwardly for engagement with the cams, and the cams do not physically move the bottom support.

The specific details of the sorter assembly are well known and adequately described in the above-mentioned patents and application. The illustrated sorter, however, is more particularly like that more specifically shown and described in the aforesaid application Ser. No. 848,489. Thus, the illustrative sorter also has a stapler 14 adapted to be automatically operated to apply staples to sets of sheets in the sorter trays.

It has been found that spiral cams of the type employed in sorters, as generally described above, are preferably made of low friction plastic materials. However, since the cam profile which is helical is best provided with a compound high lift and low lift helix angle so that engagement of the cams with the trunnions on the trays may be quieter and acceleration and deceleration of the trays is controlled. Due to the changing helix angle, the ,helical cam can not be readily molded in simple mold cavities and a complex mold construction is required. Mold parting lines leave mold lines on the finished cam which must be smoothed down or they cause undesired noise and/or errant forces as the cam followers move through the changing spiral groove. Accordingly, it is customary that the spiral grooves are machined into a plastic cam body, but this is a time consuming and costly operation.

Therefore, in accordance with the present invention, a cam structure is provided wherein the cam consists of complemental identical or nearly identical cam parts adapted to be assembled on the cam drive shaft in such a manner as to be rotated by the cam shaft in a fixed position on the shaft or in axially movable relation to the shaft.

Referring to FIGS. 2 through 4 and 4*a*, one form of cam and shaft construction is shown for use in the sorter of FIG. 1.

In this form, the cam 5 is fixedly disposed on the shaft 9. The cam is formed of a pair of complemental half parts 15 meeting on a vertical line 16 at one side of the cam only. The cam shaft 9 is of non-circular form, hexagonal as shown, to key the cam to the shaft for rotation as a unit. The cam half parts are held against relative axial movement on the shaft by mutually co-engaged means. In this form, such mutually co-engaged means interlock the cam half parts with the shaft against relative axial movement.

Cam half parts 15 are identical. Each has a hub 17 which is hollow and formed to fit on the hexagonal or other shaped non-circular shaft 9 to provide a rotary drive. To lock the cam parts on the shaft, in this form, the shaft is provided with a pair of axially spaced opposing stop shoulders 18 against which the inner ends 19 of the hubs abut. Spaced axially of the shaft from stop shoulders 18 are opposing lock lugs 20 adapted to automatically engage the outer ends of the cam hubs upon axial assembly of the hubs with the shaft.

To enable such axial assembly, the shaft is provided with slots 21 providing resiliency to the shaft at the lock lugs 20. In the region of the lock lugs the shaft has a wedge angle 22 which will cause the shaft to be resiliently deformed inwardly at the slots by the cam hubs as they are forced axially of the shaft against stop shoulders 18. Upon engagement of the hubs with stop shoulders 18, the shaft expands outwardly so that lock lugs 20 move outwardly to hold the hubs in place, as seen in FIG. 2

The cam profile is defined by a helical surface 23 extending endwise from the outer end of the hubs of the cam half parts to the opposite end of a semi-cylindrical skirt portion 24 having an elongated inner edge portion extending axially of the cam parts at which the parts meet on line 16.

The cam profile here shown is a varying helix, with a very low or zero cam angle at the line 16, so that in moving the trunnions through the cam profile, no motion is imparted to the trays by the cam profile and load on the trunnions is at the minimum, thereby minimizing any noise which may be generated by impact between the trunnions or by movement of the cam follower trunnions across the meeting line 16.

Referring again to the cam half parts, it will be seen that all surfaces are either cylindrical or on a negative helix angle except the elongated straight surface extending axially of the cam part and forming the line 16 and a short axially extended surface 25 at the outer end of the profile.

Therefore, the cam parts are easily molded in a two part mold, allowing the molded cam parts to be removed axially from the mold parts. This precludes the need for molding the complex cam profile in a mold of many parts removable radially of the cam profile surface. The cam, therefore, when assembled in a sorter, as in FIG. 1 is smoother in operation, as well as less expensive to produce than machined cams. Various other locking means may be employed to take advantage of the benefits of molded cam half parts assembled on a molded shaft to form the completed cam profile.

Figures 5, 6, 6A:
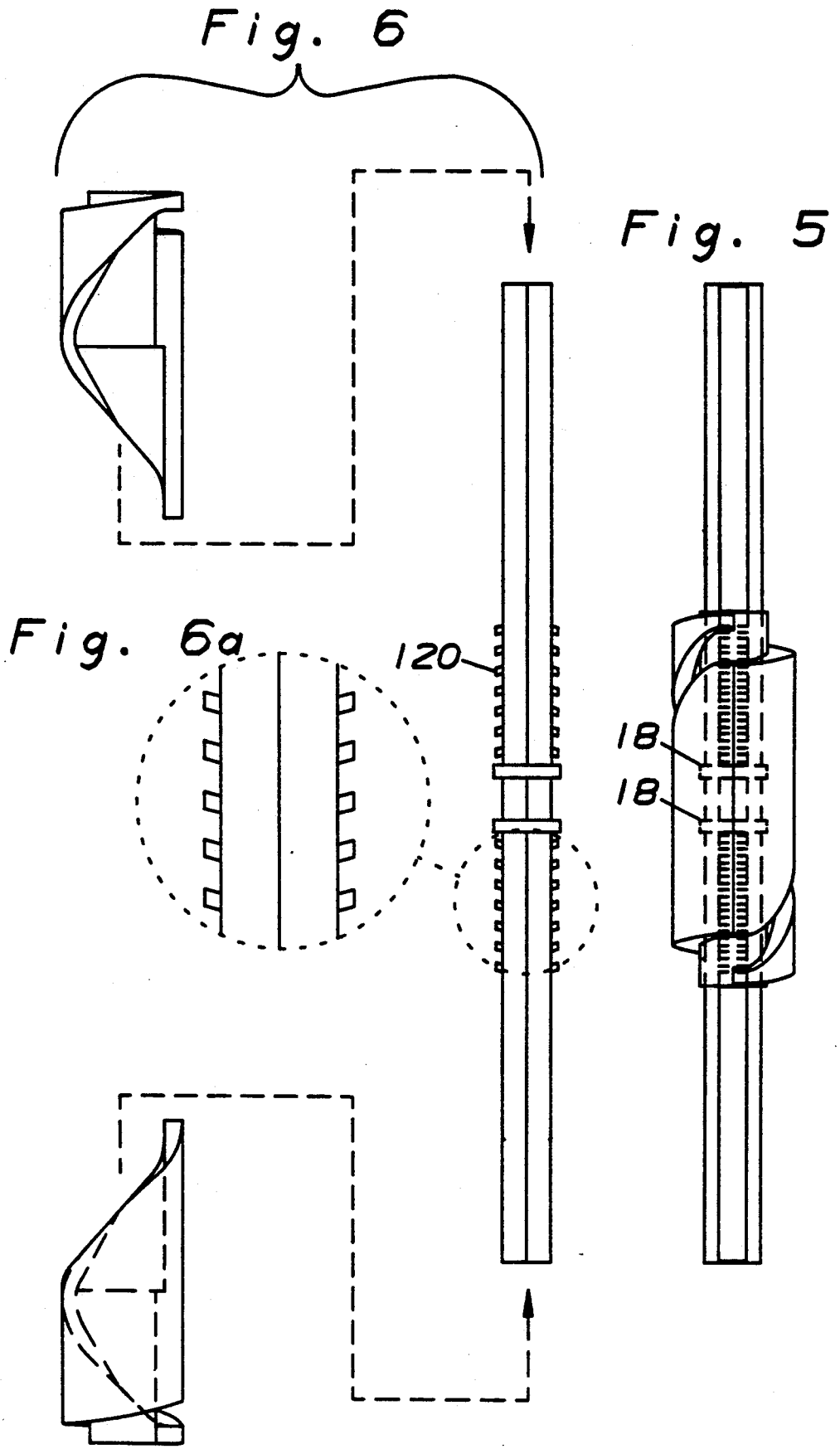
FIG. 5 is a view like FIG. 2 showing a modified construction.
FIG. 6 is an exploded detail view showing the components of the assembly of FIG. 5 but with the cam shaft rotated 90°.
FIG. 6*a* is an enlarged detail of the shaft section encircled by broken lines in FIG. 5.

Another example is shown in FIGS. 5, 6 and 6*a*. In this embodiment, the locking portions on the shaft 9 are in the form of outwardly extended locking projections 120 extending outwardly at a negative angle with respect to the direction of axial sliding movement of the hubs of the cam half parts into the shaft. When the cam half part hubs have been applied to the shaft into abutting relation to the stop shoulders 18, movement of the hubs in the opposite direction will be resisted by the positive angle of projections 120 coupled with the embedding of the projections into the plastic hubs by slight deformation of the plastic material of each part, as shown in FIG. 5.

In the case of the two forms of the invention thus far described, the shaft and cam assembly is provided by inverting the cam half parts endwise, thereby rotating them relatively 180° on their axis, applying the half parts over the opposite ends of the shaft, and sliding the cam half parts into positions on the shaft at which they are locked on the drive shaft in positions to complete the cam profile with the opposed helical cam surfaces. Such a cam and shaft structure functions in sorters of the types shown in FIG. 1.

In another form, the same assembly method is employed to provide a cam which can move axially with respect to the drive by virtue of interlocking the cam parts together without locking them on the drive shaft.

Figure 7:
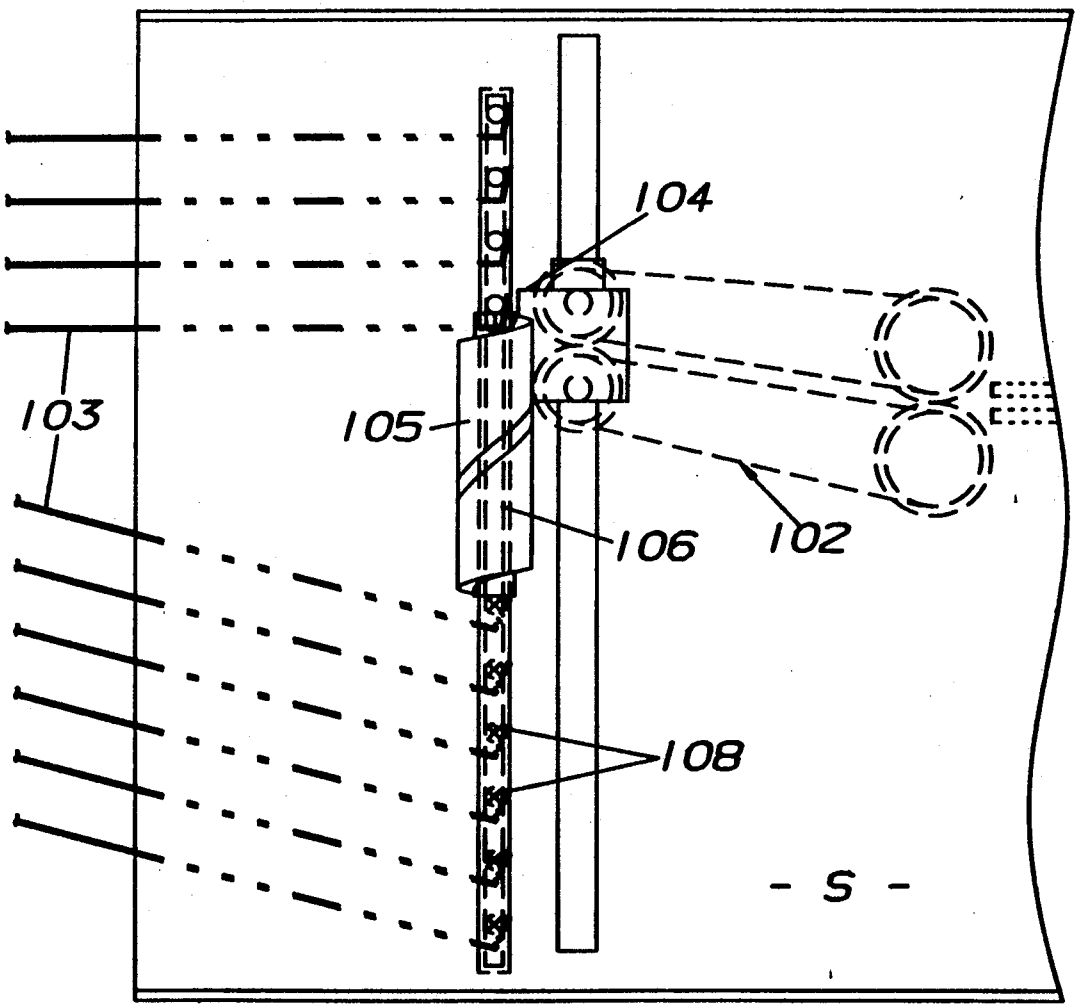
FIG. 7 is a side elevation of a sorting machine of the moving bin opener type utilizing a bin opening cam in accordance with the invention.

Referring to FIG. 7, another form of sorting machine S is shown in generality. Specifically, this sorter is more particularly shown and described in the above-referenced U.S. Pat. No. 4,478,406.

In this type of sorter, the infeed 102 for carrying sheets to the trays 103 is supported at 104 on top of the cams 105. The cams are mounted on shafts 106 so as to be axially slidable and the trunnions 108 also engage in the helical cam 105. When the shafts are rotated, the cams are rotated and the helical cam track receives the trunnions so that, depending upon the direction of rotation, the cams move up or down relative to the trays while providing an enlarged sheet entry space between adjacent trays. Since the infeed 102 is supported on the cams, the infeed moves up and down with the cams so as to feed sheets into the enlarged entry space.

Figure 8:
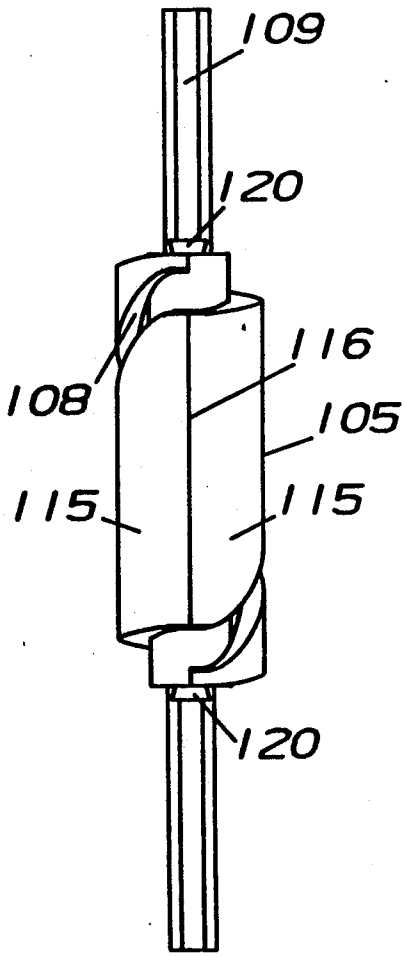
FIG. 8 is an elevational view showing a cam and shaft assembly with the cam interlocked with a core and axially movable on the shaft for use in the sorter of FIG. 7.
Figure 9:
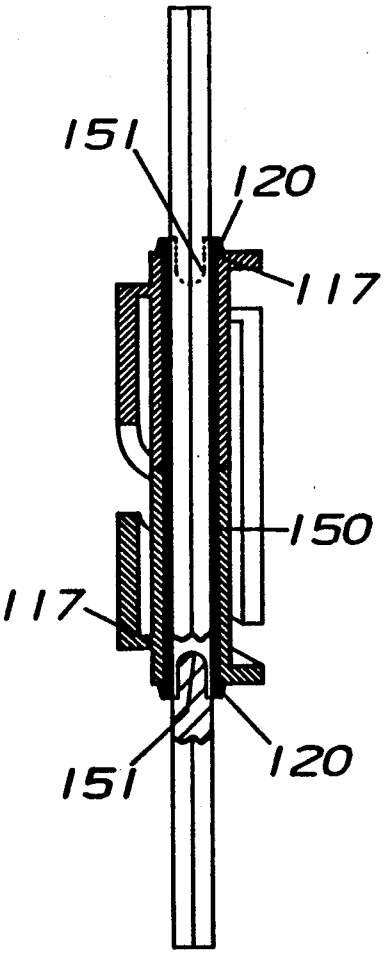
FIG. 9 is a longitudinal section showing the assembly of FIG. 8, but turned 90° on the axis.

Referring to FIGS. 8 and 9, one form of molded cam and shaft assembly is shown wherein the cam moves axially of the shaft for use in sorters of the type shown in FIG. 7.

The cam 105, again includes complemental half parts 115 meeting on a single axially extended line 116 and providing the compound helical cam track 108, as in the first described embodiment.

In this form, however, since it is necessary that the cam move axially of the shaft 109, the identical half parts are mounted on an intermediate supporting core shaft 150 which is of hexagonal section to conform with the hexagonal interior of each hub 117 of the respective cam parts and the hexagonal exterior of the shaft 109, whereby the cam assembly is keyed to the shaft for rotation but is freely axially slidable on the shaft.

The core shaft and the cam half parts are interlocked together automatically upon installation of the half parts on the core shaft.

In the illustrative form now being described, the core shaft 150 has locking lugs 120 at its ends. These lugs are on circumferentially spaced resilient portions of the core shaft formed by recesses or slots 151 in the ends of the core shaft providing for resilient inward movement of the lugs upon application of the cam half parts axially over the ends of the core shaft. Because the core shaft and cam half parts are mechanically interlocked together, the assembly is able to move vertically from tray to tray in sorters of the moving bin opener type.

Figure 10:
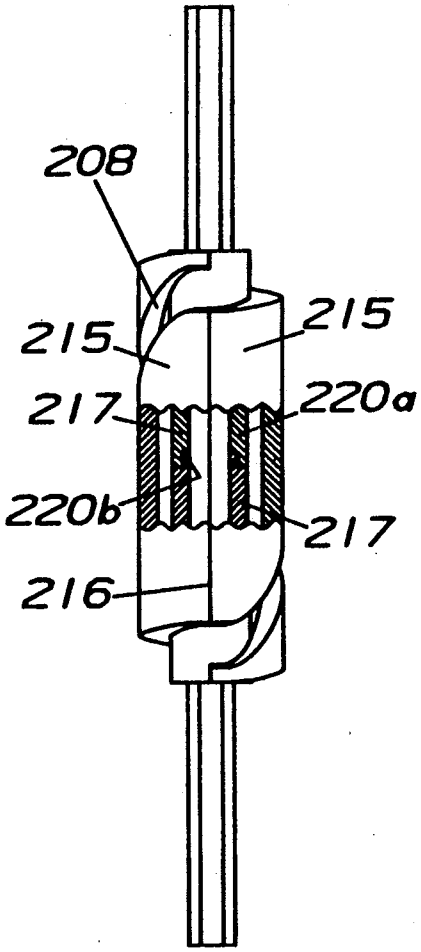
FIG. 10 is a view like FIG. 8 showing a modified construction.
Figure 11:
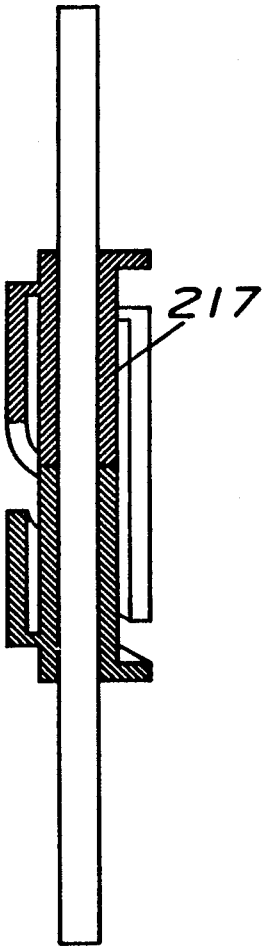
FIG. 11 is a longitudinal section showing the assembly of FIG. 10, but turned 90° on the axis.

In another form of the invention useful with moving bin opener sorters, as seen in FIGS. 10 and 11, the cam half parts 215 are directly assembled with the shaft, without utilizing a core shaft.

Here the cam half parts 215, as in other embodiments, combine to form a cam track 208 meeting on the line 216. The hubs 217 of the half parts are molded at their inner ends with flexible interlocking portions 220*a* and 220*b*. Portion 220*a* is a flange or finger having an internal locking lug, while portion 220*b* is companion flange with an external locking lug for interlocking co-engagement upon endwise assembly of the half parts on the shaft. Such locking lugs may not be full circle if desired to enhanced flexibility and removal from the mold.

In the case of sorters of the type shown in the above referred to U.S. Pat. Nos. 4,911,424 and 5,090,688 the cam half parts may be employed by the simple provision of only one stop or shoulder on the shaft, against which the lower cam part abuts, and the locking effect of the trunnions will suffice to hold the upper cam half part in its operative position relative to the lower cam part.

In some sorter constructions, the cam half parts may be positioned and locked against axial movement on the cam shaft by the simple expedient of employing snap rings engageable with the shaft above and below the upper and lower cam half parts, respectively.

From the foregoing, it will be recognized that the invention provides a cam and shaft assembly for use in sorters of the moving bin and moving bin opener types which are simple and easy to produce from molded plastic by reason of the similarity of the cam half parts and resultant simplicity of the mold. The sorters are therefore less expensive overall and yet will operate smoothly and quietly.

We claim:

1. A sheet sorting apparatus comprising: a plurality of trays disposed in a set, means supporting the trays for movement towards and away from one another to form an enlarged sheet receiving space when adjacent trays are moved away from one another with the other trays closely spaced, and rotary cam means for moving the trays, the improvement wherein said cam means includes, a cam shaft, a pair of identical molded plastic half parts each having a hub on said shaft, a portion extending axially with respect to said hub and having a helical cam surface, said cam half parts being turned end for end, and means interlocking said cam half parts together with said helical surfaces on the respective cam half parts opposing one another in spaced relation and forming a helical cam track, said hubs and said shaft being keyed together for rotation.

2. In sheet sorting apparatus as defined in claim 1, said shaft and said hubs having means interlocking said hubs on said shaft against relative axial movement.

3. In sheet sorting apparatus as defined in claim 1, said shaft being a hollow core shaft, and including a drive shaft extending axially and slidably through said hollow shaft.

4. In sheet sorting apparatus as defined in claim 1, said hubs and said shaft being keyed together for rotation, and including a drive shaft axially slidably supporting said hubs.

5. In sheet sorting apparatus as defined in claim 1, said means interlocking said cam half parts together including resiliently deformable portions on said shaft enabling endwise movement of said hubs on said shaft into interlocked relation therewith.

6. In sheet sorting apparatus as defined in claim 1, said means interlocking said cam half parts together including resiliently deformable portions of said hubs.

7. A cam and shaft assembly for use in sheet sorting machines in which the cam shifts adjacent sorting trays apart to provide a sheet entry space, said cam and shaft assembly including an elongated cam shaft, a cam on said shaft, means keying said cam on said shaft for rotation therewith, said cam being formed of a pair of substantially identical half parts turned end for end on, said shaft, a hub on each half part, an elongated skirt on each half part extending into complemental relation with the skirt of the other half part, each skirt having a surface extending longitudinally of the other half part and in opposition thereto forming an axially extended meeting line of the cam half parts at one side of the cams, and each of said half parts having a compound helical surface opposed to the compound helical surface of the other half part in spaced relation thereto to form a compound helical cam track, said parts being formed of molded plastic.

8. A cam and shaft assembly as defined in claim 7, said shaft and said cam half parts having means interlocked responsive to axial assembly of said half parts on said shaft to prevent relative axial movement of said cam parts and said shaft.

9. A cam and shaft assembly as defined in claim 8, wherein said shaft is a core shaft having a central opening for slidably receiving a drive shaft.

10. A cam and shaft assembly as defined in claim 7 wherein said half parts have means interlocking said half parts against axial separation on said shaft.

* * * * *